US008413742B2

(12) United States Patent
Ikuta et al.

(10) Patent No.: US 8,413,742 B2
(45) Date of Patent: Apr. 9, 2013

(54) IMPACT TOOL

(75) Inventors: Hiroki Ikuta, Anjo (JP); Masao Miwa, Anjo (JP); Takuya Sumi, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 12/654,115

(22) Filed: Dec. 10, 2009

(65) Prior Publication Data

US 2010/0155094 A1 Jun. 24, 2010

(30) Foreign Application Priority Data

Dec. 19, 2008 (JP) ..... 2008-324775

(51) Int. Cl.
*B25B 11/00* (2006.01)

(52) U.S. Cl. ..... 173/211; 173/90; 173/122; 173/128; 173/210

(58) Field of Classification Search ..... 173/162.1, 173/210, 211; 279/19, 19.1, 19.7
See application file for complete search history.

(56) References Cited

U.S. PATENT DOCUMENTS

| | | | | |
|---|---|---|---|---|
| 4,239,143 | A * | 12/1980 | Johnson | 227/70 |
| 4,476,941 | A * | 10/1984 | Buck et al. | 173/117 |
| 5,050,687 | A * | 9/1991 | Prokhorov et al. | 173/133 |
| 5,335,409 | A * | 8/1994 | Elvebak | 29/451 |
| 5,407,018 | A * | 4/1995 | Henry | 173/211 |
| 5,573,073 | A * | 11/1996 | Schofield et al. | 173/17 |
| 5,603,516 | A * | 2/1997 | Neumaier | 279/19.5 |
| 5,775,441 | A * | 7/1998 | Sakuragi et al. | 173/200 |
| 6,644,418 | B2 * | 11/2003 | Haga | 173/48 |
| 7,523,791 | B2 * | 4/2009 | Aoki | 173/210 |
| 7,878,265 | B2 * | 2/2011 | Aoki | 173/210 |
| 2007/0175647 | A1 * | 8/2007 | Aoki | 173/210 |

(Continued)

FOREIGN PATENT DOCUMENTS

| | | |
|---|---|---|
| BE | 440 894 | 4/1941 |
| JP | A-1-289677 | 11/1989 |

(Continued)

OTHER PUBLICATIONS

European Search Report issued in European Patent Application No. 09015506.0 mailed on Mar. 24, 2010.

(Continued)

*Primary Examiner* — Rinaldi Rada
*Assistant Examiner* — Eyamindae Jallow
(74) *Attorney, Agent, or Firm* — Oliff & Berridge, PLC

(57) ABSTRACT

It is an object of the invention to reduce noise caused by run-out of a tool bit in an impact tool. The representative impact tool according to the invention includes a tool holder 137 that houses a tool bit 119 in such a manner that the tool bit can linearly move in its axial direction, and a barrel 108 that is integrally connected to the tool holder 137 The impact tool further includes an elastic element 155 that is disposed between an inner circumferential surface of the tool holder 137 and an outer circumferential surface of the tool bit 119 in an end region of the tool bit 119 on the barrel side and connected in close contact with the tool holder 137 and the tool bit 119 over a predetermined length of the tool bit 119 in the axial direction. The elastic element 155 applies a biasing force to prevent a run-out of the tool bit 119 in a direction transverse to the axial direction. Further, an intermediate element 145 comes in point contact with the tool bit 119 on its axial center line.

4 Claims, 4 Drawing Sheets

U.S. PATENT DOCUMENTS

| | | | | |
|---|---|---|---|---|
| 2008/0185165 | A1 | 8/2008 | Moessnang | |
| 2008/0210451 | A1* | 9/2008 | Aoki | 173/211 |
| 2009/0223693 | A1 | 9/2009 | Aoki | |
| 2009/0236110 | A1* | 9/2009 | Iwakami et al. | 173/122 |

FOREIGN PATENT DOCUMENTS

| | | | |
|---|---|---|---|
| JP | A-2002-254352 | | 9/2002 |
| JP | A-2004-154903 | | 6/2004 |
| JP | A-2006-062044 | | 3/2006 |
| JP | A-2007-237301 | | 9/2007 |
| JP | A-2008-188760 | | 8/2008 |
| WO | WO 2007/000899 | A1 | 1/2007 |
| WO | WO 2007/105742 | A1 | 9/2007 |

OTHER PUBLICATIONS

Sep. 10, 2012 Office Action issued in Japanese Patent Application No. 2008-177156 (with translation).

Jan. 31, 2013 Office Action issued in Japanese Patent Application No. JP-A-2008-324775.

* cited by examiner

IMPACT TOOL

BACKGROUND OF THE INVENTION

1. Field of the Invention

The invention relates to a noise reduction in an impact tool such as a hammer and a hammer drill.

2. Description of the Related Art

Japanese Patent Publication No. 2646108 discloses an impact tool which performs a hammering operation on a workpiece such as concrete. When the tool bit is driven and the hammering operation is performed, the tool bit receives a reaction force from the workpiece.

In many cases, the reaction force includes not only axial components but also radial components, such that the tool bit undergoes run-out in a radial direction. Such radial run-out is caused not only in the tool bit but also in an intermediate element such as an impact bolt because the impact bolt is in contact with the tool bit. When the tool bit and the impact bolt undergo radial run-out and hit a tool holder for holding them, a metal-against-metal sound caused by such hitting generate noise to the outside via the tool holder and the barrel connected to the tool holder.

SUMMARY OF THE INVENTION

Accordingly, it is an object of the invention to effectively reducing noise which is caused by run-out of a tool bit in an impact tool.

Above-described object can be achieved by a claimed invention. Representative impact tool according to the invention includes a tool holder that houses the tool bit and a barrel integrally connected to the tool holder. The impact tool further includes a striking element housed within the barrel to perform a linear movement and an intermediate element also housed within the barrel to be driven by the striking element to linearly move in the axial direction into contact with the tool bit, thereby transmitting a driving force to the tool bit. The intermediate element comes in point contact with the tool bit on its axial center line. At least any one of the intermediate element and the tool bit may be formed with a spherical surface in order to provide the point contact.

The impact tool further includes an elastic element that is disposed between an inner circumferential surface of the tool holder and an outer circumferential surface of the tool bit in an end region of the tool bit on the barrel side and connected in close contact with the tool holder and the tool bit over a predetermined length of the tool bit in the axial direction. With this construction, the elastic element applies a biasing force to prevent a run-out of the tool bit in a direction transverse to the axial direction.

According to the invention, when the tool bit undergoes run-out in a direction transverse to the axial direction by the reaction force applied from the workpiece to the tool bit during an operation of the impact tool, the elastic element disposed between the tool bit and the tool holder applies a biasing force to prevent the run-out of the tool bit. As a result, the run-out of the tool bit can be minimized so that hitting of the tool bit against the tool holder can be avoided or reduced. Further, because the intermediate element comes in point contact with the tool bit, movement of the tool bit in any direction other than the axial direction is prevented from being transmitted to the intermediate element. Thus, run-out of the intermediate element can be alleviated. In this manner, noise caused by run-out of the tool bit can be effectively reduced.

According to a further aspect of the invention, the elastic element may be connected in close contact with the tool bit only partly in a circumferential direction of the tool bit. For this feature, the elastic element may be shaped like a ring which is continuous in the circumferential direction, and an inner wall surface of the ring can be shaped such that the ring is held in contact with the tool bit at a plurality of points in its circumferential direction. Alternatively, the elastic element may be formed by a plurality of elastic elements spaced apart from each other in the circumferential direction.

In an impact tool such as an electric hammer and a hammer drill, the tool bit can be held in such a manner as to be linearly movable by inserting a shank of the tool bit into a bit holding hole of the tool holder in the longitudinal direction. According to the invention, the elastic element is held in contact with the tool bit only partly in its circumferential direction. Therefore, when the tool bit is inserted into the bit holding hole of the tool holder in order to attach the tool bit to the tool holder, the elastic element can be more easily deformed so that the tool bit can be more easily inserted into the bit holding hole of the tool holder.

According to a further aspect of the invention, the elastic element may have a ring-like shape and one of the tool bit and the elastic element may have a circular section and the other may have a polygonal section.

According to a further aspect of the invention, at least part of the intermediate element may be disposed within the tool holder, a sleeve may be disposed between the intermediate element and the tool holder, and an elastic member may be disposed between the sleeve and the tool holder.

According to a further aspect of the invention, the intermediate element may come in point contact with the striking element on its longitudinal center line. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
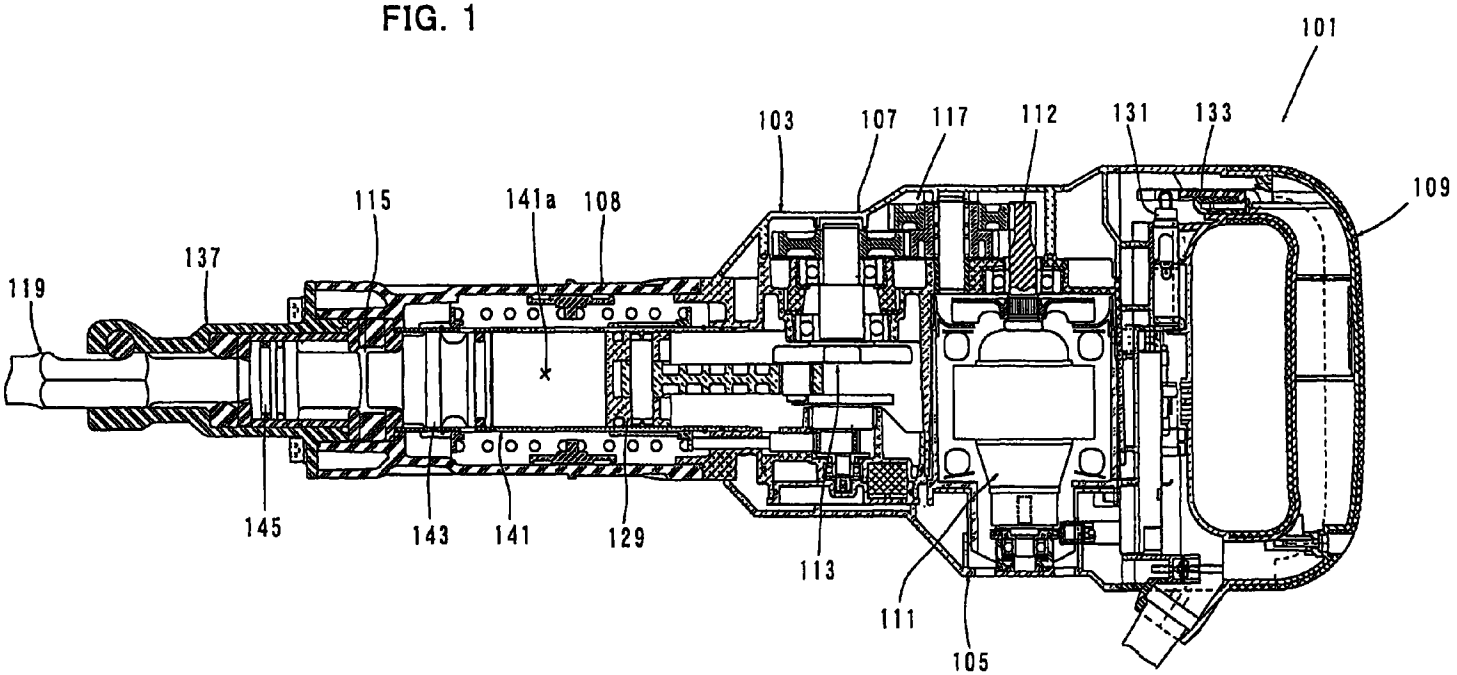
FIG. 1 is a sectional side view showing an entire electric hammer 101 according to a representative embodiment of the invention.
Figure 2:
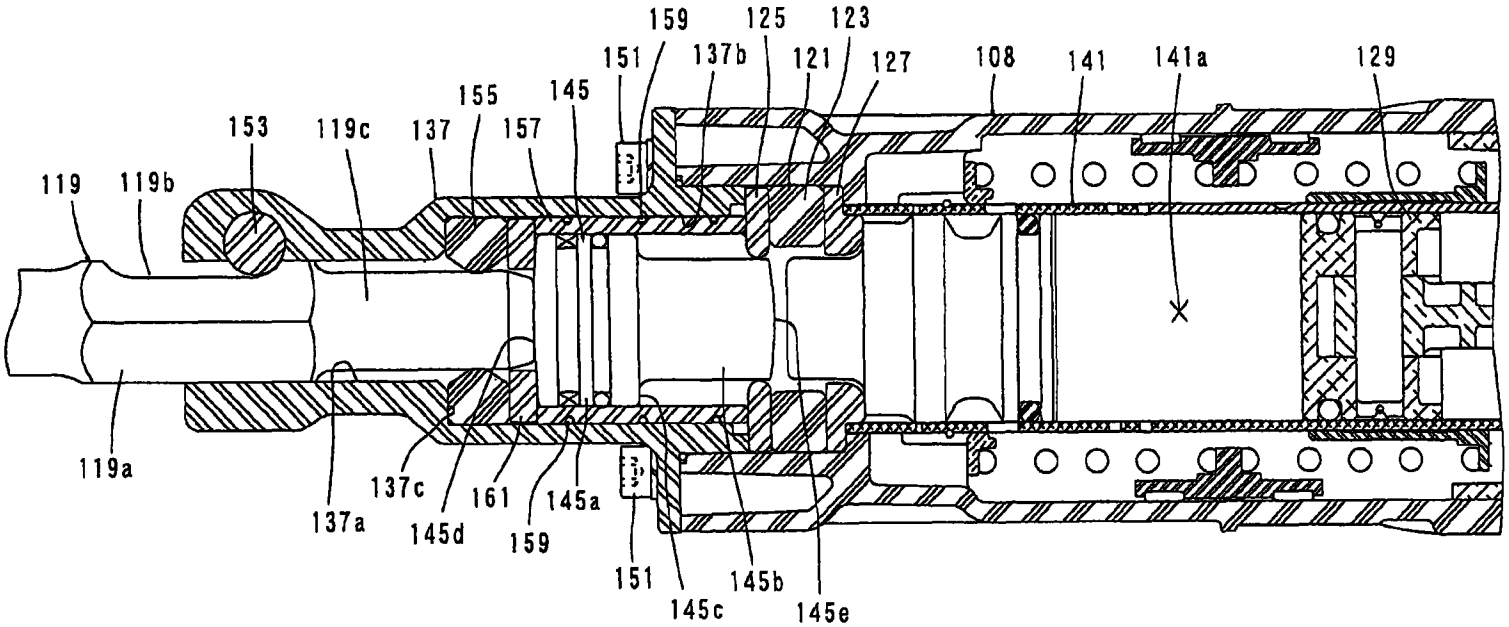
FIG. 2 is an enlarged sectional view of a part (on a hammer bit side) of FIG. 1, under unloaded conditions in which the hammer bit 119 is not pressed against a workpiece.
Figure 3:
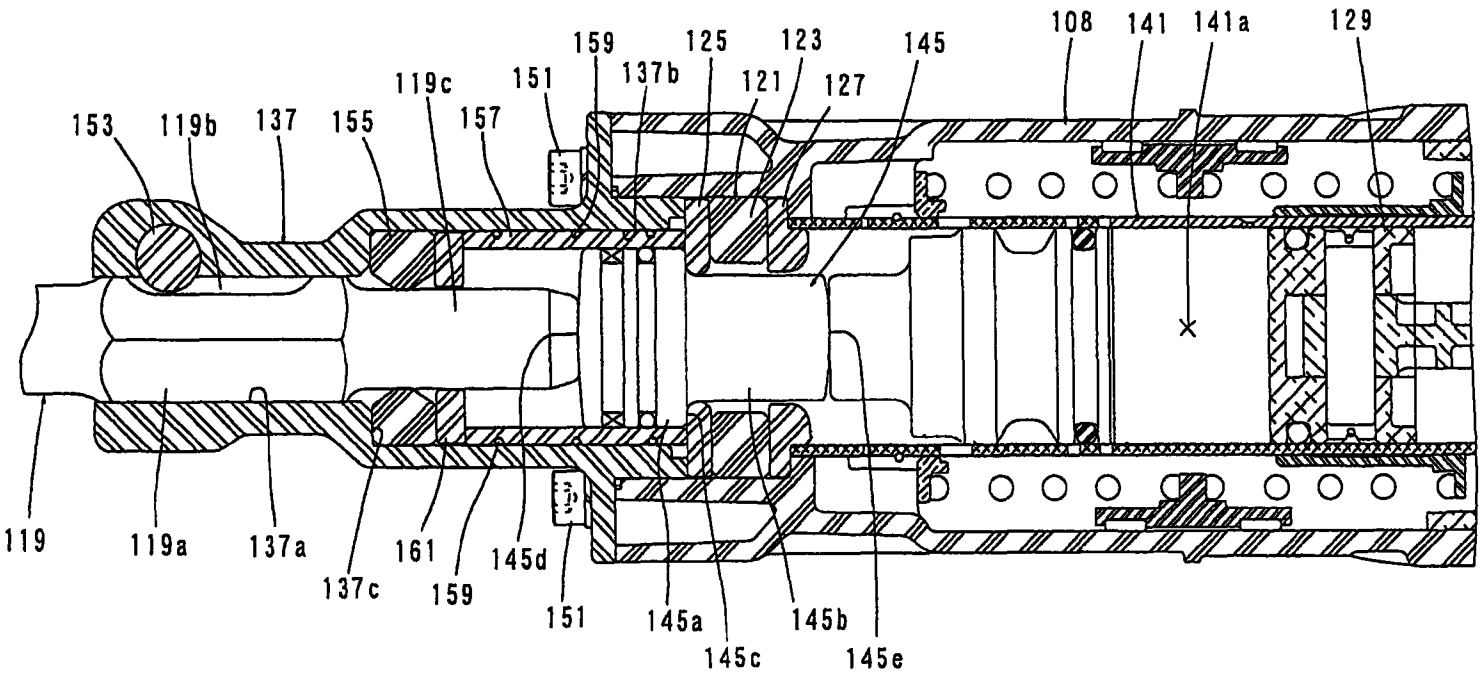
FIG. 3 is an enlarged sectional view of the part (on the hammer bit side) of FIG. 1, under loaded conditions in which the hammer bit 119 is pressed against a workpiece.
Figure 4:
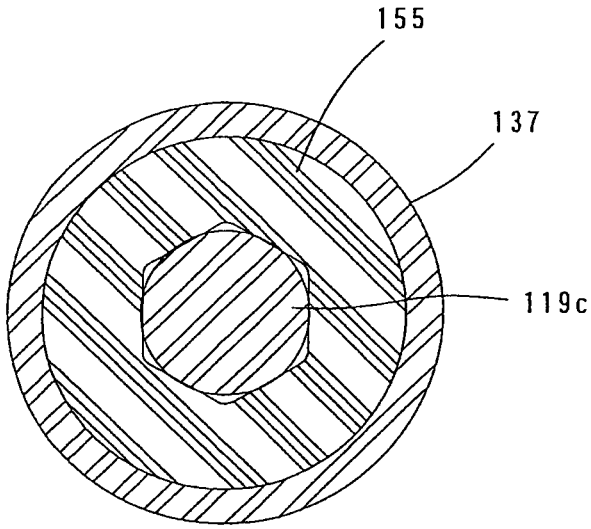
FIG. 4 is a sectional view showing a structure of fitting a rubber ring 155 on a small-diameter portion 119*c* of the hammer bit 119.
Figure 5:
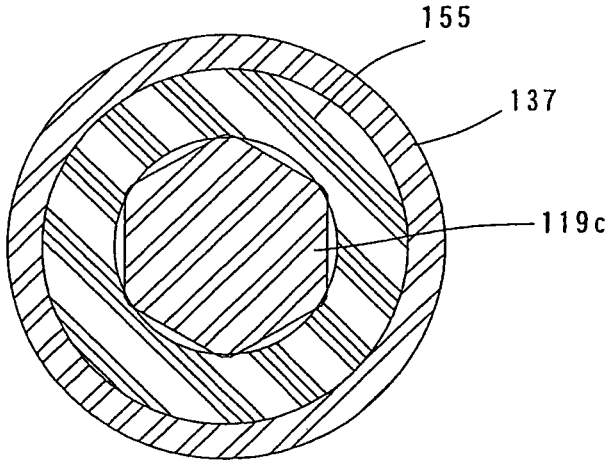
FIG. 5 is a sectional view showing a variant of the structure of fitting the rubber ring 155 on the small-diameter portion 119*c* of the hammer bit 119.

A representative embodiment of the invention is now described with reference to FIGS. 1 to 5. FIG. 1 shows an entire electric hammer 101 as a representative embodiment of an impact tool according to the invention. FIGS. 2 and 3 are partly enlarged views of the electric hammer 101 in FIG. 1, under unloaded conditions in which a hammer bit 119 is not pressed against a workpiece and under loaded conditions in which the hammer bit 119 is pressed against the workpiece, respectively. FIG. 4 shows a structure of fitting a rubber ring 155 on a small-diameter portion 119*c* of the hammer bit 119, and FIG. 5 shows a variant of the structure of fitting the rubber ring 155 on the small-diameter portion 119*c* of the hammer bit 119.

As shown in FIG. 1, the electric hammer 101 according to this representative embodiment mainly includes a tool body in the form of a body 103 that forms an outer shell of the electric hammer 101, a tool holder 137 connected to a tip end region (on the left side as viewed in FIG. 1) of the body 103 in its longitudinal direction, a hammer bit 119 detachably mounted to the tool holder 137 and a handgrip 109 that is connected to the other end (on the right side as viewed in FIG. 1) of the body 103 in its longitudinal direction and designed to be held by a user. The hammer bit 119 is a feature that corresponds to a "tool bit" according to the invention. The hammer bit 119 is held by the tool holder 137 such that it is allowed to reciprocate with respect to the tool holder in its axial direction (the longitudinal direction of the body 103) and prevented from rotating with respect to the tool holder in its circumferential direction. For the sake of convenience of explanation, in a horizontal position of the body 103 in which the axial direction of the hammer bit 119 coincides with a horizontal direction, the side of the hammer bit 119 is taken as the front, and the side of the handgrip 109 as the rear.

The body 103 mainly includes a motor housing 105 that houses a driving motor 111, a gear housing 107 that is connected to the motor housing 105 and houses a motion converting mechanism 113 and a gear speed reducing mechanism 117, and a tubular barrel 108 that is connected to the gear housing 107 and houses a striking mechanism 115. The gear housing 107 is disposed in a region in front of and above the motor housing 105. The barrel 108 is disposed on a front end of the gear housing 107 and extends forward on an axis of the hammer bit 119. Further, a handgrip 109 is connected to the rear of the motor housing 105 and forms a D-shaped handle. An electric switch 131 that energizes the driving motor 111 and an operating member 133 that is operated to move the electric switch 131 between an on position and an off position are disposed in an upper region of the handgrip 109. The operating member 133 is mounted to the handgrip 109 such that it can slide in a horizontal direction (transverse direction) transverse to the axial direction of the hammer bit. When the user slides the operating member 133 by the finger in order to move the electric switch 133 to the on position, the driving motor 111 is energized.

A rotating output of the driving motor 111 is appropriately converted into linear motion by the motion converting mechanism 113 and then transmitted to the striking mechanism 115. As a result, an impact force is generated in the axial direction of the hammer bit 119 via the striking mechanism 115. The driving motor 111 is disposed such that an axis of the output shaft 112 extends in a direction transverse to the axis of the hammer bit 119. The motion converting mechanism 113 is housed in an upper region of an internal space of the gear housing 107 and serves to convert the rotating output of the driving motor 111 to linear motion and transmit it to the striking mechanism 115.

The motion converting mechanism 113 which serves to convert rotation of the driving motor 111 to linear motion and transmit it to the striking mechanism 115, mainly includes a crank mechanism. The crank mechanism is designed such that, when the crank mechanism is rotationally driven by the driving motor 111, a piston 129 forming a final movable member of the crank mechanism linearly moves in the axial direction of the hammer bit within a cylinder 141. The piston 129 is a feature that corresponds to the "driving element" according to the invention. The crank mechanism is disposed in front of the driving motor 111 and driven by the driving motor 111 at reduced speed via the gear speed reducing mechanism 117 which is formed by a plurality of gears. The constructions of the motion converting mechanism 113 and the gear speed reducing mechanism 117 are well known, and therefore their detailed explanation is omitted.

The striking mechanism 115 mainly includes a striking element in the form of a striker 143 that is slidably disposed within a bore of the cylinder 141 together with the piston 129, and an impact bolt 145 that is slidably disposed within the tool holder 137. The striker 143 is driven via an air spring action or pressure fluctuations of an air chamber 141*a* of the cylinder 141 which is caused by sliding movement of the piston 129, and then the striker 143 collides with the impact bolt 145 and transmits the striking force to the hammer bit 119 via the impact bolt 145. The striker 143 and the impact bolt 145 are features that correspond to the "striking element" and the "intermediate element", respectively, according to the invention.

As shown in FIGS. 2 and 3, the impact bolt 145 is configured as a stepped columnar member that has a large-diameter portion 145*a*, a small-diameter portion 145*b* and a radial stepped portion 145*c* formed in a boundary region between the large- and small-diameter portions 145*a*, 145*b*, in the axial direction of the impact bolt 145. Further, the impact bolt 145 is disposed within the tool holder 137 with the large-diameter portion 145*a* at the front and the small-diameter portion 145*b* at the rear.

The electric hammer 101 has a positioning member 121. When a user applies a forward pressing force to the body 103 and thus the hammer bit 119 is pressed against a workpiece, which is defined as loaded conditions as shown in FIG. 3, the impact bolt 145 is pushed rearward to the piston 129 side together with the hammer bit 119. In this state, the positioning member 121 comes into contact with the stepped portion 145*c* of the impact bolt 145 and thereby positions the body 103 with respect to the workpiece. The positioning member 121 is configured as a unit part which includes a rubber ring 123, a hard front metal washer 125 which is connected to an axial front surface of the rubber ring 123 and can be held in contact with the stepped portion 145*c* of the impact bolt 145, and a hard rear metal washer 127 which is connected to an axial rear surface of the rubber ring 123 and held in contact with the front end surface of the cylinder 141. The positioning member 121 can be loosely fitted onto the small-diameter portion 145*b* of the impact bolt 145. Further, the cylinder 141 is prevented from moving rearward in the axial direction by the gear housing 107 (see FIG. 1).

The tool holder 137 is detachably connected to the tip end region of the barrel 108 by screws 151. The tool holder 137 is configured as a bit holding member and has a bit holding hole 137*a* having a hexagonal section through which the hammer bit 119 is inserted. The hammer bit 119 has a polygonal shank 119*a* having a hexagonal section in the middle in its axial direction, and the polygonal shank 119*a* is inserted and fitted into the bit holding hole 137*a*, so that the hammer bit 119 is prevented from rotating with respect to the tool holder 137.

A planar notch 119*b* is formed on a circumferential part of the polygonal shank 119*a* of the hammer bit 119 and extends a predetermined length in the axial direction. A tool retainer 153 is provided on the tool holder 137 and serves to prevent the hammer bit 119 inserted into the bit holding hole 137*a* from slipping-off. The tool retainer 153 is a rod-like shaped pin member having a circular section and disposed transversely to the axial direction of the hammer bit 119. Further, the tool retainer 153 is engaged with a rear end portion of the notch 119*b* of the hammer bit 119 and thus prevents the hammer bit 119 from slipping off. In this state, the hammer bit 119 is allowed to move with respect to the tool holder 137 in the axial direction within a range of the length of the notch 119*b*. Further, a planar notch, which is not shown, is formed on a circumferential part of the tool retainer 153 and extends a predetermined length in its longitudinal direction. When the tool retainer 153 is turned around its axis to a position in which the notch of the tool retainer 153 is opposed to the notch 119*b* of the hammer bit 119, the tool retainer 153 is disengaged from the notch 119*b*, so that the hammer bit 119 is allowed to be removed from the bit holding hole 137*a*.

A bore 137*b* having a circular section and a diameter larger than that of the bit holding hole 137*a* is formed in a rear end region of the tool holder 137. A small-diameter portion 119*c* having a circular section and a diameter smaller than that of the polygonal shank 119*a* is formed in the rear end portion of the hammer bit 119. In a state in which the hammer bit 119 is inserted into the bit holding hole 137*a* and prevented from slipping off (as shown in FIG. 2), the small-diameter portion 119*c* is located within the bore 137*b*. A rubber ring 155 having a ring hole of a polygonal section is fitted in the bore 137*b* in close contact with the bore wall surface. Therefore, when the hammer bit 119 is inserted into the bit holding hole 137*a*, the rubber ring 155 elastically holds the small-diameter portion 119*c* inserted into the hole of the rubber ring 155.

Specifically, the rubber ring 155 is disposed between the wall surface of the bore 137*b* and the small-diameter portion 119*c* on the rear end portion of the hammer bit 119, and held in close contact with the wall surface of the bore 137*b* and the outer circumferential surface of the small-diameter portion 119*c* over a predetermined length of the hammer bit 119 in its axial direction. Therefore, when the hammer bit 119 linearly moves in its axial direction, the rubber ring 155 exerts a biasing force on the hammer bit 119 in directions that minimize run-out of the hammer bit 119 in a direction (hereinafter referred to as a radial direction) transverse to its axial direction. The rubber ring 155 is a feature that corresponds to the "elastic element" according to the invention.

Further, as shown in FIG. 4, the ring hole of the rubber ring 155 has a hexagonal shape and the small-diameter portion 119*c* of the hammer bit 119 has a circular section. With this construction, the rubber ring 155 holds the small-diameter portion 119*c* in contact at six points in the circumferential direction. Therefore, when the hammer bit 119 is inserted into the bit holding hole 137*a* in order to be mounted to the tool holder 137, the small-diameter portion 119*c* is held in contact with the ring hole wall surface of the rubber ring 155 partly in the circumferential direction, and in this state, the small-diameter portion 119*c* is inserted into the ring hole of the rubber ring 155. At this time, compared with a construction, for example, in which the small-diameter portion is held in contact with the ring hole wall surface in its entirety in the circumferential direction, the rubber ring 155 can be more easily deformed, so that the hammer bit 119 can be more easily inserted into the bit holding hole 137*a*.

The front surface of the rubber ring 155 is held in contact with an end surface 137*c* which is radially formed in a stepped portion between the bore 137*b* and the bit holding hole 137*a*, so that the rubber ring 155 is prevented from moving further forward. Further, a sleeve 157 is disposed on the rear of the rubber ring 155 (on the striker 143 side). The sleeve 157 serves as a member for preventing the rubber ring 155 from moving rearward. An axial rear end of the sleeve 157 is held in contact with the front metal washer 125 of the positioning member 121 and its axial front end is held in contact with a rear surface of the rubber ring 155 via a metal washer 161. With this construction, the rubber ring 155 is disposed within the bore 137*b* of the tool holder 137 in the state in which it is prevented from moving in the axial direction. Further, the metal washer 161 is loosely fitted onto the small-diameter portion 119*c* of the hammer bit 119.

Further, the sleeve 157 also serves as a member for guiding a linear movement of the impact bolt 145. The sleeve 157 is coaxially disposed within the bore 137*b* of the tool holder 137 and the impact bolt 145 is slidably fitted into the bore. An external diameter of the sleeve 157 is smaller than a bore diameter of the bore 137*b* of the tool holder 137, so that a predetermined clearance is defined between the outer circumferential surface of the sleeve and the bore wall surface. Further, a plurality of (three in this representative embodiment) O-rings 159 are fitted on the sleeve 157 at predetermined intervals in the axial direction, and the sleeve 157 is connected to the tool holder 137 via the O-rings 159. With this construction, the O-rings 159 serve to prevent or reduce transmission of vibration from the impact bolt 145 to the tool holder 137 via the sleeve 157. The O-ring 159 is a feature that corresponds to the "elastic member" according to the invention.

Further, a front end surface 145*d* and a rear end surface of the impact bolt 145 in the axial direction are spherically shaped such that an impact from the hammer bit 119 to the impact bolt 145 and an impact from the impact bolt 145 to the striker 143 are transmitted in the axial direction. A rear end surface of the hammer bit 119 and a front end surface of the striker 143 each comprise a planar surface perpendicular to the axial direction. Therefore, the impact bolt 145 comes in spherical contact with the rear end surface of the hammer bit 119 and the front end surface of the striker 143. Specifically, the impact bolt 145 comes in point contact with the hammer bit 119 and the striker 143 on its axial center line. The rear end surface of the hammer bit 119 and the front end surface of the striker 143 may also be spherically shaped. Further, all of the hammer bit 119, the tool holder 137, the barrel 108, the sleeve 157, the impact bolt 145 and the striker 143 are made of metal.

In the electric hammer 101 constructed as described above, when the driving motor 111 is driven, the piston 129 of the crank mechanism linearly moves within the cylinder 141, which causes the striker 143 to be driven via the air spring action of the air chamber 141*a*. Then, the striker 143 applies a striking force in the axial direction to the hammer bit 119 via the impact bolt 145. In this manner, the hammer bit 119 is caused to linearly move in the axial direction and performs a hammering operation on the workpiece.

During the above-described hammering operation, a reaction force is applied from the workpiece to the hammer bit 119 after striking movement. This reaction force may include not only axial components, but also radial components, so that the hammer bit 119 may linearly move while undergoing run-out in a direction transverse to the axial direction.

Accordingly, in this representative embodiment, the rubber ring 155 fitted into the bore 137*b* of the tool holder 137 holds the small-diameter portion 119*c* of the hammer bit 119 in the rear end region of the hammer bit 119 and applies a biasing force in the directions that prevent or minimize the radial rounout of the hammer bit 119. Therefore, even if the reaction force having not only axial components but also radial components is applied from the workpiece to the hammer bit 119, the radial nm-out of the hammer bit 119 can be prevented or minimized. Thus, hitting of the hammer bit 119 against the tool holder 137 can be avoided or reduced. As a result, noise (metal-against-metal sound which is caused by a bump between the hammer bit 119 and the tool holder 137) which is released to the outside via the tool holder 137 and the barrel 108 connected to the tool holder 137 can be reduced.

Further, in this representative embodiment, the impact bolt 145 is designed to come in contact with the rear end surface of the hammer bit 119 via its spherical surface. Therefore, even if the hammer bit 119 comes in contact with the impact bolt 145 while undergoing radial run-out, impact which is caused by the reaction force from the hammer bit 119 is applied to the impact bolt 145 in the axial direction. Specifically, even if the hammer bit 119 linearly moves while undergoing run-out in the radial direction, movement of the hammer bit 119 in any direction other than the axial direction is prevented from being transmitted to the impact bolt 145. Thus, run-out of the impact bolt 145 can be prevented or alleviated.

Further, in this representative embodiment, the sleeve 157 is disposed between the impact bolt 145 and the tool holder 137, and the O-rings 159 are disposed between the outer periphery of the sleeve 157 and the wall surface of the bore 137*b* of the tool holder 137. Therefore, transmission of vibration from the impact bolt 145 to the tool holder 137 via the sleeve 157 can be prevented or reduced by the O-rings 159. As a result, noise which is released to the outside via the tool holder 137 and the barrel 108 connected to the tool holder 137, can be further reduced.

Further, as for the structure of fitting the rubber ring 155 on the small-diameter portion 119*c* of the hammer bit 119, the ring hole of the rubber ring 155 has a hexagonal shape and the small-diameter portion 119*c* has a circular shape. However, as shown in FIG. 5, it may be the other way around, or specifically, the ring hole of the rubber ring 155 may have a circular shape and the small-diameter portion 119*c* may have a hexagonal shape. Further, any polygonal shape other than the hexagonal shape may be used. Further, in order to be held in contact with the small-diameter portion 119*c* of the hammer bit 119 at a plurality of points in the circumferential direction, the rubber ring 155 can be configured to have an inner wall surface having axially extending projections and depressions which are alternately arranged in the circumferential direction. Further, as the elastic element, a plurality of elastic elements which are spaced apart from each other in the circumferential direction can be used in place of the rubber ring 155.

Further, a metal spring can also be used as the elastic element in place of the rubber ring 155. The metal spring may be provided, for example, such that a plurality of axially extending leaf springs are spaced apart from each other in the circumferential direction, or such that a tubular element is formed as its base and a plurality of axially extending spring pieces which are cut and raised radially inward of the tubular element are disposed in the circumferential direction.

Further, in this representative embodiment, the elastic element is formed by the rubber ring 155 and configured to be held in contact with the small-diameter portion 119*c* of the hammer bit 119 at a plurality of points in the circumferential direction, but it may be configured to be held in contact in its entirety in the circumferential direction.

Further, in this representative embodiment, the front end surface 145*d* and the rear end surface 145*e* of the impact bolt 145 are spherically shaped such that an impact from the hammer bit 119 to the impact bolt 145 and an impact from the impact bolt 145 to the striker 143 are transmitted in the axial direction. However, in addition, the rear end surface of the hammer bit 119 and the front end surface of the striker 143 may also be spherically shaped. Alternatively, the front end surface 145*d* and the rear end surface 145*e* of the impact bolt 145 may each comprise a planar surface perpendicular to the axial direction, while the rear end surface of the hammer bit 119 and the front end surface of the striker 143 may each comprise a spherical surface.

Further, in the above-described representative embodiment, the electric hammer 101 is explained as a representative example of the impact tool. However, this representative embodiment is not limited to the electric hammer and can also be applied to a hammer drill which can drive the hammer bit to perform hammering movement in the axial direction and drilling movement in the circumferential direction.

Further, having regard to the above-described aspects, following features can be provided:

"When the hammer bit side is defined as the front and the driving mechanism side as the rear, the rubber ring disposed within the tool holder is prevented from moving forward by a wall surface which is radially formed in the tool holder, and further prevented from moving rearward by a sleeve which is disposed within the tool holder and prevented from moving rearward".

"A ring-like washer may be disposed between the rubber ring and the sleeve".

DESCRIPTION OF NUMERALS

101 electric hammer (impact tool)
103 body (tool body)
105 motor housing
107 gear housing
108 barrel
109 handgrip
111 driving motor
112 output shaft
113 motion converting mechanism
115 striking mechanism
117 gear speed reducing mechanism
119 hammer bit (tool bit)
119*a* polygonal shank
119*b* notch
119*c* small-diameter portion
121 positioning member
123 rubber ring
125 front metal washer
127 rear metal washer
129 piston
131 electric switch
133 operating member
137 tool holder
137*a* bit holding hole
137*b* bore
137*c* end surface
141 cylinder

141*a* air chamber
143 striker (striking element)
145 impact bolt (intermediate element)
145*d* front end surface
145*e* rear end surface
151 screw
153 tool retainer
155 rubber ring (elastic element)
157 sleeve
159 O-ring (elastic member)

What we claim is:

1. An impact tool comprising:

a tool holder that houses a tool bit that linearly moves in an axial direction of the tool bit, a barrel integrally connected to the tool holder, a striking element housed within the barrel, the striking element performing a linear movement, an intermediate element housed within the barrel, the intermediate element being driven by the striking element and caused to linearly move in the axial direction into contact with the tool bit, thereby transmitting a driving force to the tool bit, the intermediate element coming in point contact with the tool bit on an axial center line of the tool bit, and an elastic element that is disposed between an inner circumferential surface of the tool holder and an outer circumferential surface of the tool bit in an end region of the tool bit on the barrel side, an outer circumferential surface and an inner circumferential surface of the elastic element being connected in close contact with the inner circumferential surface of the tool holder and the outer circumferential surface of the tool bit, respectively, over a predetermined length of the tool bit in the axial direction to apply a biasing force to prevent a run-out of the tool bit in a direction transverse to the axial direction, wherein the elastic element is connected in close contact with the tool bit only partly in a circumferential direction of the tool bit, the elastic element has a ring-like shape, one of the tool bit and the elastic element has a circular section and the other has a polygonal section, at least part of the intermediate element is disposed within the tool holder, a sleeve is disposed between the intermediate element and the tool holder, and an elastic member is disposed along an outer circumferential surface of the sleeve and between the sleeve and the tool holder.

2. The impact tool as defined in claim 1, wherein the intermediate element comes in point contact with the striking element on an axial center line of the striking element.

3. The impact tool as defined in claim 1, wherein, when a hammer bit side is defined as forward and a driving mechanism side is defined as rearward; a rubber ring disposed within the tool holder is prevented from moving forward by a wall surface which is radially formed in the tool holder, and further prevented from moving rearward by a sleeve which is disposed within the tool holder and prevented from moving rearward.

4. The impact tool as defined in claim 3, wherein a ring-like washer is disposed between the rubber ring and the sleeve.

* * * * *